US010829920B2

(12) United States Patent
Yu

(10) Patent No.: US 10,829,920 B2
(45) Date of Patent: Nov. 10, 2020

(54) TOILET CLEAN DEVICE

(71) Applicant: Mu-Tsun Yu, Taichung (TW)

(72) Inventor: Mu-Tsun Yu, Taichung (TW)

( * ) Notice: Subject to any disclaimer, the term of this patent is extended or adjusted under 35 U.S.C. 154(b) by 0 days.

(21) Appl. No.: 16/445,244

(22) Filed: Jun. 19, 2019

(65) Prior Publication Data

US 2020/0011039 A1 Jan. 9, 2020

(30) Foreign Application Priority Data

Jul. 6, 2018 (TW) ..... 107123445 A

(51) Int. Cl.
*B08B 9/043* (2006.01)
*B08B 9/045* (2006.01)
*E03C 1/302* (2006.01)

(52) U.S. Cl.
CPC ..... *E03C 1/302* (2013.01); *B08B 9/045* (2013.01); *B08B 9/0436* (2013.01)

(58) Field of Classification Search
CPC ..... B08B 9/0436; B08B 9/045; E03C 1/302
See application file for complete search history.

(56) References Cited

U.S. PATENT DOCUMENTS 4,771,500 A * 9/1988 Kovacs ..... B08B 9/045 15/104.33
5,230,116 A * 7/1993 Rodriguez ..... E03D 11/00 15/104.33
6,421,871 B1 * 7/2002 Peach ..... B08B 9/045 15/104.05
2016/0298325 A1 * 10/2016 Yu ..... E03F 9/005
2017/0232484 A1 * 8/2017 Kehoe ..... B65H 75/364 15/104.095

* cited by examiner

*Primary Examiner* — Randall E Chin

(57) ABSTRACT

A toilet clean device has a long pipe, a joint pipe, and an adjustable elbow pipe. The long pipe is hollow and has a longitudinal cutting slot. The joint pipe is fluidly communicated with a bottom end of the long pipe. The adjustable elbow pipe is fluidly communicated with the joint pipe and the direction, the curvature, and the angle thereof may be adjusted freely. Therefore, the toilet clean device may adapt for any size of the pipeline of the toilet. The structure of the toilet clean device is not only simplified and easy to be assembled and disassembled, but also the toilet clean device is easy to be operated.

6 Claims, 7 Drawing Sheets

TOILET CLEAN DEVICE

FIELD OF THE INVENTION

The present invention relates to a toilet equipment, and more particularly to a toilet clean device.

BACKGROUND OF THE INVENTION

The toilet which is used every day by the people in today's world keeps clean with flushing the excrement and then the excrement in the toilet is exhausted through the pipeline of the toilet. When the pipeline of the toilet is clogged by clogs or obstructions, a toilet clean device is used for dredging the pipeline.

The current toilet clean device may be a plunger. The plunger has a hemispheric suction cup and a grip which is assembled at the top surface of the suction cup. While in use, the hemispheric suction cup is aligned with the open end of the pipeline and then the grip is forced by pushing and pulling to make the suction cup be pressed and restored. When the suction cup is pressed and restored, the water pressure in the pipeline is changed so as to dredge the clogs or obstructions in the pipeline.

However, in practical use, since the hemispheric suction cup is hard to fully cover the open end of the pipeline of the toilet so that the closure property is not very well, the amount of the changes of the pressure is finite/limited so that the clean effect or dredging effect is not very well while the hemispheric suction cup presses the water in the pipeline. Simultaneously, the suction cup is pressed and restored by pushing and pulling the grip so that the air between the suction cup and the pipeline is sucked back upwardly to result in the mephitis diffused in the air.

In view of the foregoing circumstances, the inventor has invested a lot of time to study the relevant knowledge, compare the pros and cons, research and develop related products. After quite many expetireents and tests, the "toilet clean device" of this invention is eventually launched to improve the foregoing shortcomings, to meet the public use.

SUMMARY OF THE INVENTION

An object of this invention is providing a toilet clean device. The joint pipe which has the inner annular concave groove and the longitudinal rib is used to fluidly communicate with the long pipe which has the longitudinal cutting groove so as to fix the long pipe to prevent from rotation while in operation. The outer convex arc cylinder portion of the joint pipe is used to fluidly communicate with the adjustable elbow pipe so that the adjustable elbow pipe may be movably adjusted in any desired direction. In addition, the adjustable elbow pipe includes a plurality of socket sections and two adjacent socket sections are movably and fluidly communicated with each other by the respective funnel portion and the respective hemisphere portion of their own so as to adjust the direction, curvature, and angle to adapt the pipelines according to the different standard toilets. Compared to the prior art, the toilet clean device of the present invention is not necessary to disassemble and change the pipes with different curvatures and angles. It is not only the structure is simplified and easy to be assembled and disassembled, but also it is easy to be operated.

To achieve above objects, a toilet clean device may comprise a long pipe, being hollow and having a longitudinal cutting groove; a joint pipe, fluidly communicated with and jointed with a bottom end of the long pipe, the joint pipe has a circular cylinder portion, a longitudinal rib, an outer convex arc cylinder portion, and an inner annular concave groove, a bottom end of the circular cylinder portion is fluidly communicated with the outer convex arc cylinder portion, the inner annular concave groove is surrounded in the circular cylinder portion and arranged adjacent to the outer convex arc cylinder portion, the longitudinal rib is arranged in the circular cylinder portion and extended from a top end of the circular cylinder portion toward the connection of the circular cylinder portion and the outer convex arc cylinder portion, the longitudinal rib is arranged corresponding to the longitudinal cutting groove of the long pipe so as to position the long pipe, and an bottom end of the long pipe is inserted into the inner annular concave groove and also tightly press-fit in the inner annular concave groove; an adjustable elbow pipe, fluidly communicated with the joint pipe, the adjustable elbow pipe is able to adjust in any desired direction, curvature, and angle, the adjustable elbow pipe has a plurality of socket sections which are connected with each other in series, and further a cone pipe section is formed at a bottom end of the adjustable elbow pipe, and a top end of the adjustable elbow pipe is fluidly communicated with the outer convex arc cylinder portion; and a dredging strip, arranged in the long pipe, the joint pipe, and the adjustable elbow pipe, and two ends of the dredging strip is respectively exposed to the long pipe and the adjustable elbow pipe.

In some embodiments, each of the socket sections which are fluidly communicated with each other in series includes a funnel portion and a hemisphere portion, the funnel portion of the upmost socket section is fluidly communicated with and jointed with the outer convex arc cylinder portion, two adjacent socket sections are movably and fluidly communicated with each other by the respective funnel portion and the respective hemisphere portion of their own, a larger diameter end of the cone pipe section is fluidly communicated with the hemisphere portion of the lowermost socket section, and a smaller diameter end of the cone pipe section which is opposite to the larger diameter is arranged toward a direction which is distant away from the socket section.

In some embodiments, the end of the dredging strip which id exposed to the long pipe is connected with an electric drill tool.

In some embodiments, the end of the dredging strip which is exposed to the adjustable elbow pipe is curly and elliptical.

In some embodiments, the dredging strip is made by a metal line which is wound to form a hollow spiral shape.

In some embodiments, an outer diameter of the dredging strip is smaller than a width of the longitudinal cutting groove.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
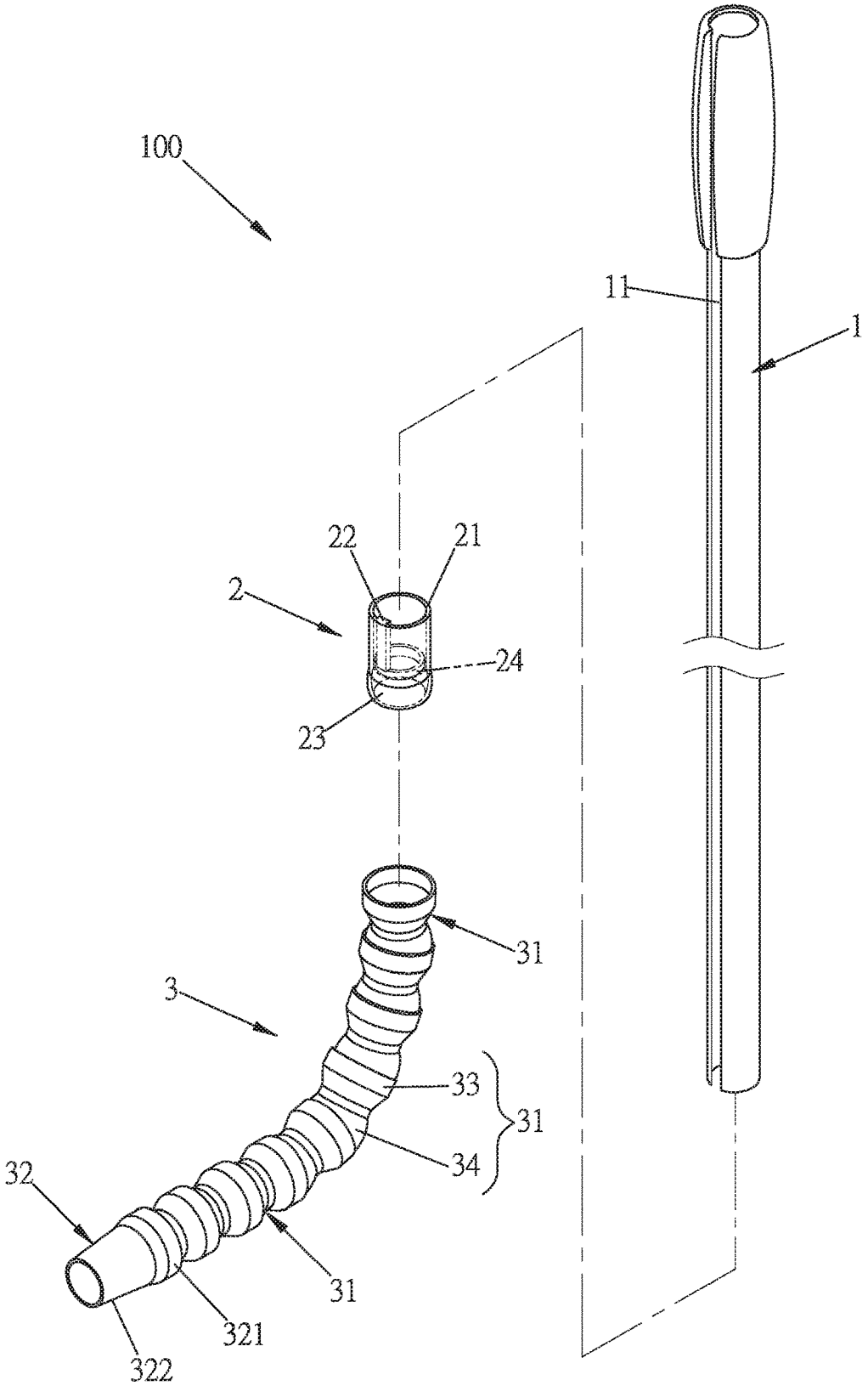
FIG. 1 is an exploded view of a toilet clean device of the present invention.

Referring now to the drawings where like characteristics and features among the various figures are denoted by like reference characters.

Please refer to FIGS. 1 to 7, the toilet clean device 100 of the present invention comprises a long pipe 1, a joint pipe 2, and an adjustable elbow pipe 3.

The long pipe 1 is hollow and has a longitudinal cutting groove 11.

The joint pipe 2 is fluidly communicated with and jointed with a bottom end of the long pipe 1.

The adjustable elbow pipe 3 is fluidly communicated with the joint pipe 2 and may be adjusted in any desired direction, curvature, and angle.

Figure 4:
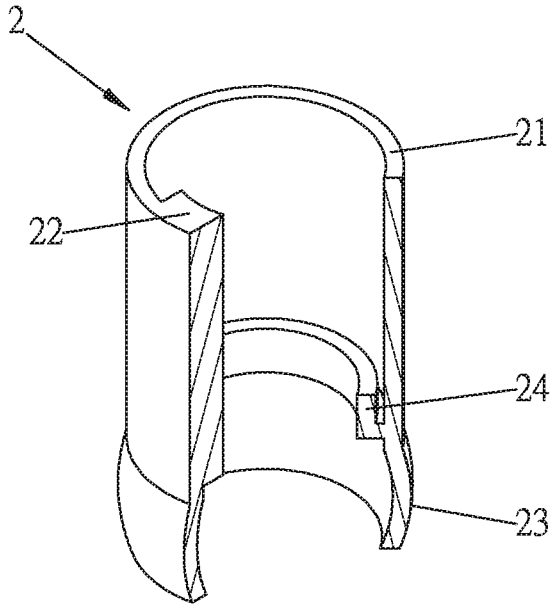
FIG. 4 is a cross-sectional view of a joint pipe of the toilet clean device of the present invention.

Please refer to FIG. 4, the joint pipe 2 has a circular cylinder portion 21, a longitudinal rib 22, an outer convex arc cylinder portion 23, and an inner annular concave groove 24. A bottom end of the circular cylinder portion 21 is fluidly communicated with the outer convex arc cylinder portion 23. The inner annular concave groove 24 is surrounded in the circular cylinder portion 21 and arranged adjacent to the outer convex arc cylinder portion 23. The longitudinal rib 22 is arranged in the circular cylinder portion 21 and extended from a top end of the circular cylinder portion 21 toward the connection of the circular cylinder portion 21 and the outer convex arc cylinder portion 23. The longitudinal rib 22 is arranged corresponding to the longitudinal cutting groove 11 of the long pipe 1 so as to position the long pipe 1 to prevent the long pipe 1 from rotation while in operation. And a bottom end of the long pipe 1 is inserted into the inner annular concave groove 24 and also tightly press-fit in the inner annular concave groove 24 so that the long pipe 1 is detachably fixed to the joint pipe 2. And a top end of the adjustable elbow pipe 3 is fluidly communicated with the outer convex arc cylinder portion 23.

Figure 2:
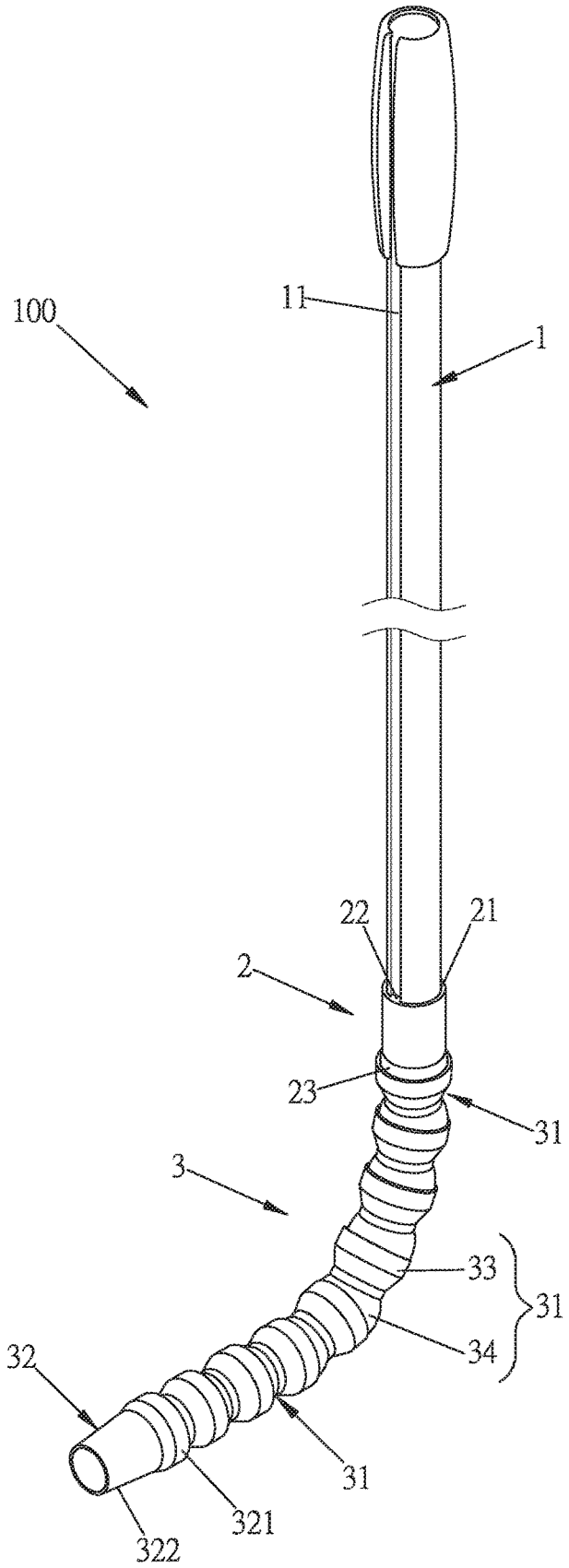
FIG. 2 is a perspective view of the toilet clean device of the present invention.
Figure 3:
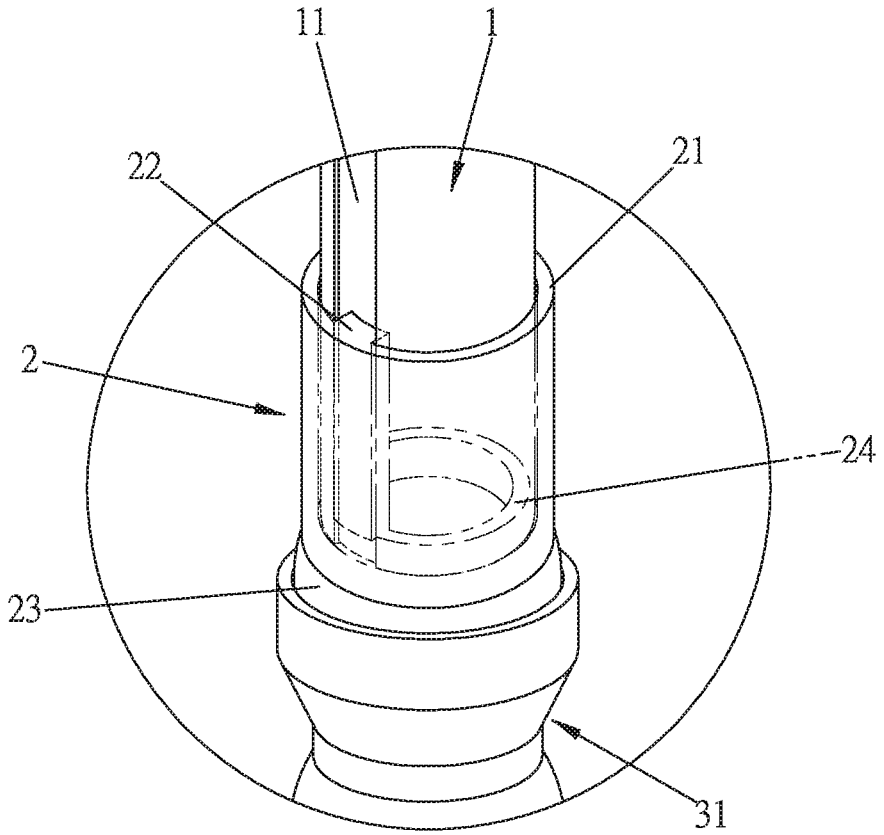
FIG. 3 is a partially enlarged view of the toilet clean device of the present invention.

Please also refer to FIGS. 1 to 3, the adjustable elbow pipe 3 has a plurality of socket sections 31 which are connected with each other in series. And further a cone pipe section 32 is formed at a bottom end of the adjustable elbow pipe 3. Each of the socket sections 31 which are fluidly communicated with each other in series includes a funnel portion 33 and a hemisphere portion 34. The funnel portion 33 of the upmost socket section 31 is fluidly communicated with and jointed with the outer convex arc cylinder portion 23 of the joint pipe 2. Two adjacent socket sections 31 are movably and fluidly communicated with each other by the respective funnel portion 33 and the respective hemisphere portion 34 of their own. A larger diameter end 321 (funnel-shaped) of the cone pipe section 32 is fluidly communicated with the hemisphere portion 34 of the lowermost socket section 31, and a smaller diameter end 322 of the cone pipe section 32 which is opposite to the larger diameter 321 is arranged toward a direction which is distant away from the socket section 31.

Therefore, since two adjacent socket sections 31 are movably fluidly communicated with each other by the respective funnel portion 33 and the respective hemisphere portion 34 of their own, the adjustable elbow pipe 3 may be adjusted in any desired direction, curvature, and angle.

Figure 5:
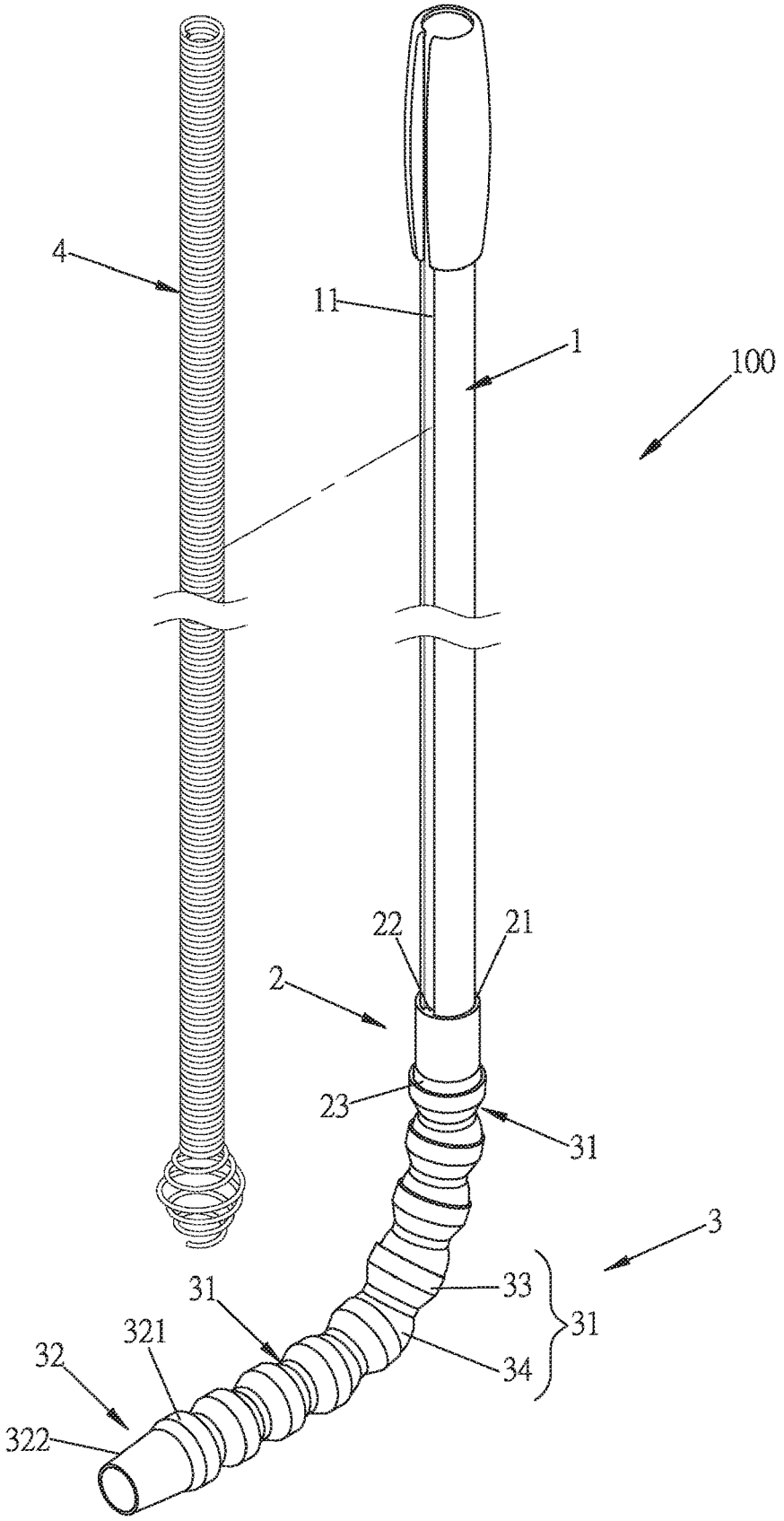
FIG. 5 is an exploded view of the toilet clean device of the present invention which is connected with a dredging strip.
Figure 6:
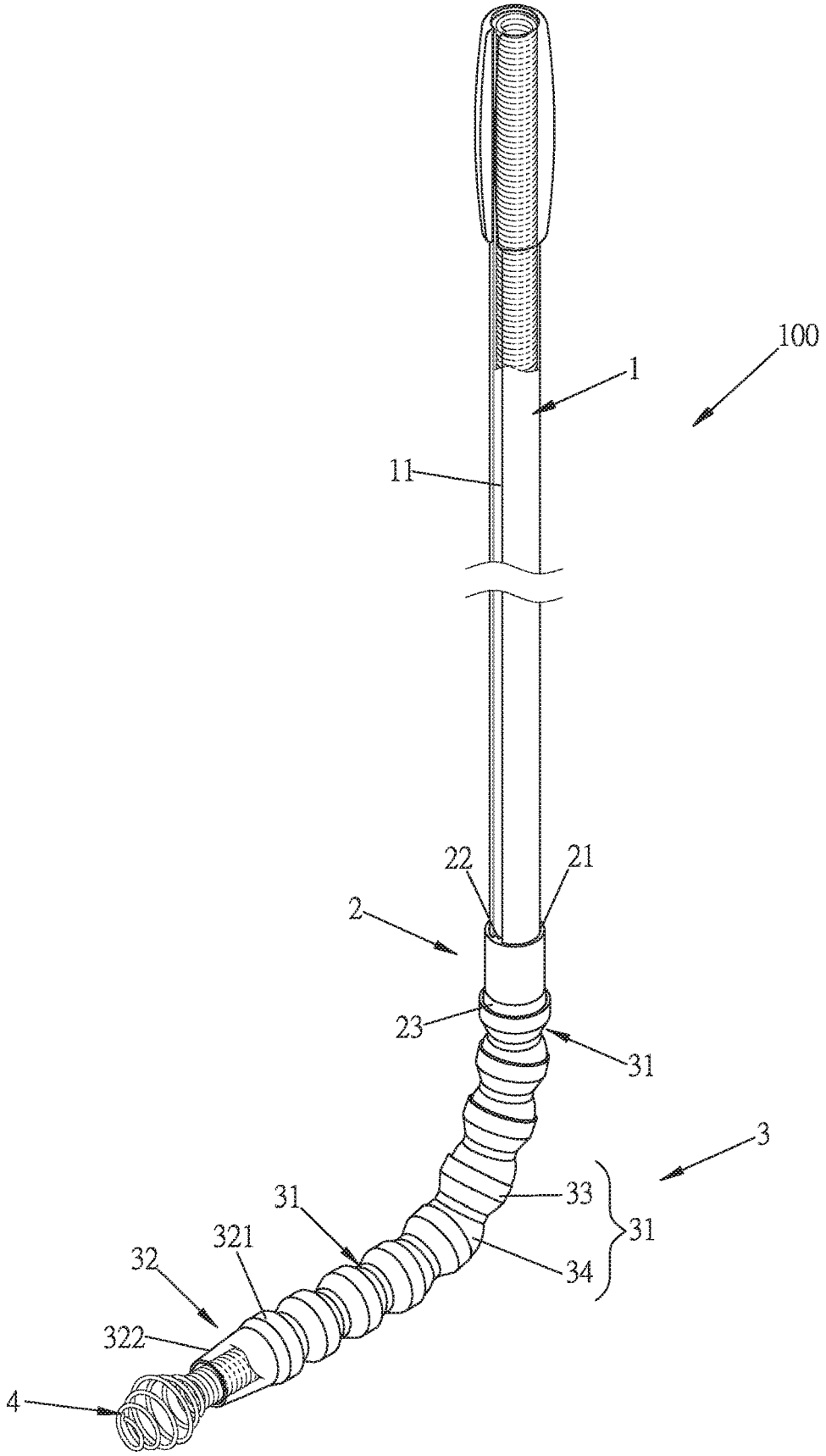
FIG. 6 is a perspective view of the toilet clean device of the present invention which is connected with the dredging strip.

Please refer to FIGS. 5 and 6, the toilet clean device 100 of the present invention may further comprise a dredging strip 4. The dredging strip 4 is arranged in the long pipe 1, the joint pipe 2, and the adjustable elbow pipe 3. Two ends of the dredging strip 4 is respectively exposed to the long pipe 1 and the adjustable elbow pipe 3. The dredging strip 4 is made by a metal line which is wound to form a hollow spiral shape. An outer diameter of the dredging strip 4 is smaller than a width of the longitudinal cutting groove 11 so that the dredging strip 4 may be arranged in the long pipe 1 from the longitudinal cutting groove 11 or the dredging strip 4 may be movable at the longitudinal cutting groove 11.

Figure 7:
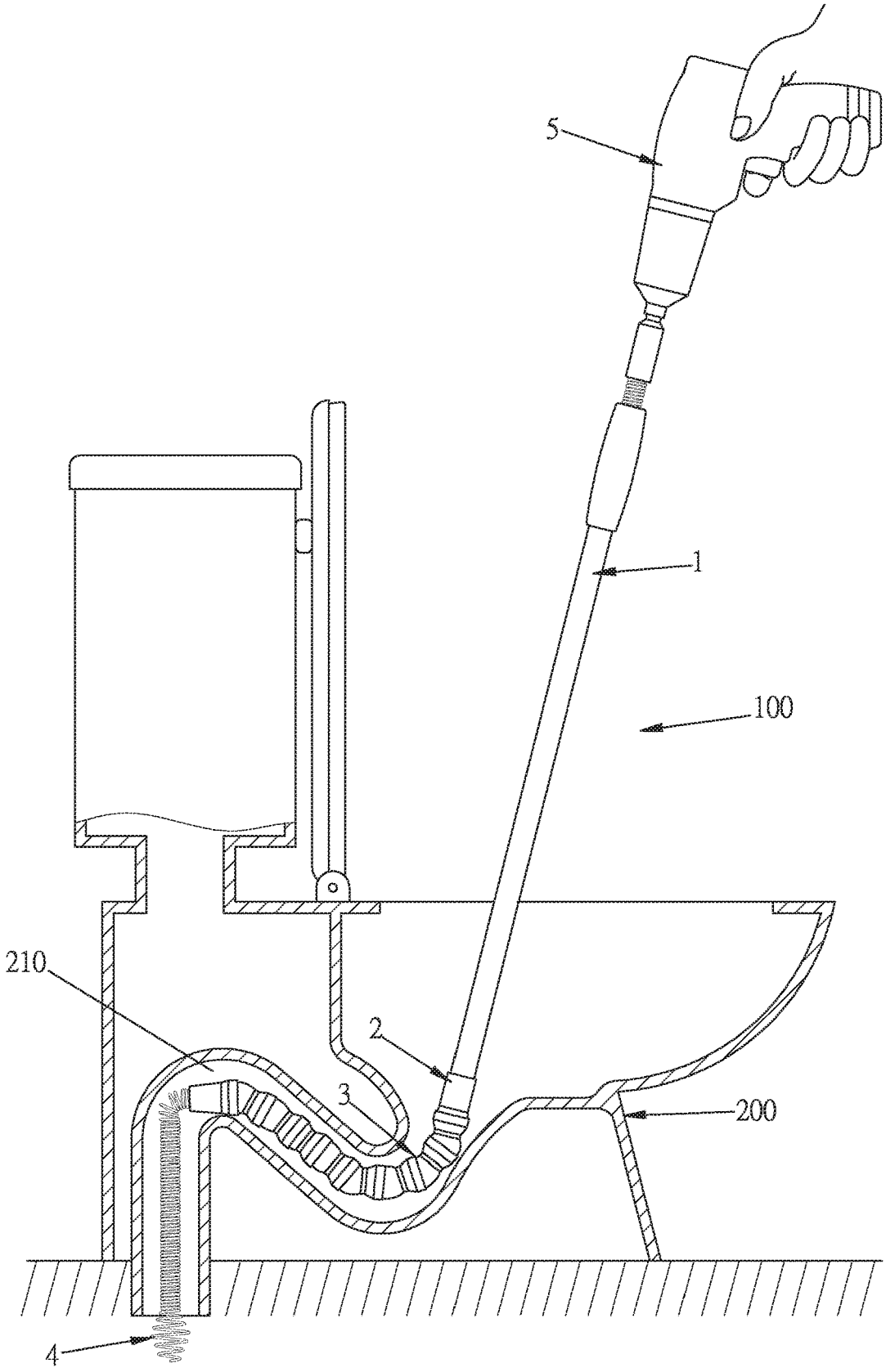
FIG. 7 is an operational view of the toilet clean device of the present invention.

Please refer to FIG. 7, the end of the dredging strip 4 which is exposed to the long pipe 1 is connected with an electric drill tool 5, and the end of the dredging strip 4 which is exposed to the adjustable elbow pipe 3 is curly and elliptical.

Please refer to FIG. 7, while in operation, the adjustable elbow pipe 3 may be adjusted to insert into the pipeline 210 of the toilet 200 according to the curvature and the angel of angle pipeline 210. And further, the curly and elliptical end of the dredging strip 4 may be inserted deep into the abyss of the pipeline 210 of the toilet 200. And then, the electric drill tool 5 drives the dredging strip 4 to rotate so as to gather the clogs or obstructions in the abyss of the pipeline 210 to remove upwardly.

According to above mentioned structure, the joint pipe 2 which has the inner annular concave groove 24 and the longitudinal rib 22 is used to fluidly communicate with the long pipe 1 which has the longitudinal cutting groove 11 so as to fix the long pipe 1 to prevent from rotation while in operation. The outer convex arc cylinder portion 23 of the joint pipe 2 is used to fluidly communicate with the adjustable elbow pipe 3 so that the adjustable elbow pipe 3 may be movably adjusted in any desired direction. In addition, the adjustable elbow pipe 3 includes a plurality of socket sections 31 and two adjacent socket sections 31 are movably and fluidly communicated with each other by the respective funnel portion 33 and the respective hemisphere portion 34 of their own so as to adjust the direction, curvature, and angle to adapt the pipelines 210 according to the different standard toilets 200. Compared to the prior art, the toilet clean device of the present invention is not necessary to disassemble and change the pipes with different curvatures and angles. It is not only the structure is simplified and easy to be assembled and disassembled, but also it is easy to be operated.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A toilet clean device, comprising:

a long pipe, being hollow and having a longitudinal cutting groove;

a joint pipe, fluidly communicated with and jointed with a bottom end of the long pipe, the joint pipe has a circular cylinder portion, a longitudinal rib, an outer convex arc cylinder portion, and an inner annular concave groove, a bottom end of the circular cylinder portion is fluidly communicated with the outer convex arc cylinder portion, the inner annular concave groove is surrounded in the circular cylinder portion and arranged adjacent to the outer convex arc cylinder portion, the longitudinal rib is arranged in the circular cylinder portion and extended from a top end of the circular cylinder portion toward the connection of the circular cylinder portion and the outer convex arc cylinder portion, the longitudinal rib is arranged corresponding to the longitudinal cutting groove of the long pipe so as to position the long pipe, and a bottom end of the long pipe is inserted into the inner annular concave groove and also tightly press-fit in the inner annular concave groove;

an adjustable elbow pipe, fluidly communicated with the joint pipe, the adjustable elbow pipe is able to adjust in any desired direction, curvature, and angle, the adjustable elbow pipe has a plurality of socket sections which are connected with each other in series, and further a cone pipe section is formed at a bottom end of the adjustable elbow pipe, and a top end of the adjustable elbow pipe is fluidly communicated with the outer convex arc cylinder portion; and a dredging strip, arranged in the long pipe, the joint pipe, and the adjustable elbow pipe, and two ends of the dredging strip is respectively exposed to the long pipe and the adjustable elbow pipe.

2. The toilet clean device as claimed in claim 1, wherein each of the socket sections which are fluidly communicated with each other in series includes a funnel portion and a hemisphere portion, the funnel portion of the upmost socket section is fluidly communicated with and jointed with the outer convex arc cylinder portion, two adjacent socket sections are movably and fluidly communicated with each other by the respective funnel portion and the respective hemisphere portion of their own, a larger diameter end of the cone pipe section is fluidly communicated with the hemisphere portion of the lowermost socket section, and a smaller diameter end of the cone pipe section which is opposite to the larger diameter is arranged toward a direction which is distant away from the socket section.

3. The toilet clean device as claimed in claim 1, wherein the end of the dredging strip which is exposed to the long pipe is connected with an electric drill tool.

4. The toilet clean device as claimed in claim 1, wherein the end of the dredging strip which is exposed to the adjustable elbow pipe is curly and elliptical.

5. The toilet clean device as claimed in claim 1, wherein the dredging strip is made by a metal line which is wound to form a hollow spiral shape.

6. The toilet clean device as claimed in claim 1, wherein an outer diameter of the dredging strip is smaller than a width of the longitudinal cutting groove.

* * * * *